United States Patent [19]

Masaki

[11] Patent Number: 4,812,804

[45] Date of Patent: Mar. 14, 1989

[54] CONTROLLER FOR ELECTRIC DEVICES DIRECTED TO USE IN BATH

[75] Inventor: Kazumi Masaki, Osaka, Japan

[73] Assignee: Ken Hayashibara, Okayama, Japan

[21] Appl. No.: 92,403

[22] Filed: Sep. 1, 1987

[30] Foreign Application Priority Data

Sep. 9, 1986 [JP] Japan ..... 61-138372[U]

[51] Int. Cl.[4] ..... H01C 10/50

[52] U.S. Cl. ..... 338/200; 338/201; 338/12; 338/164; 338/32 R

[58] Field of Search ..... 338/200, 201, 189, 164, 338/32 R, 12; 200/1 A

[56] References Cited

U.S. PATENT DOCUMENTS

| | | | |
|---|---|---|---|
| 2,456,261 | 12/1948 | Giannini | 338/12 |
| 2,537,733 | 1/1951 | Brenner | 338/12 |
| 2,862,088 | 11/1958 | Mairs | 338/164 X |
| 2,917,721 | 12/1959 | Kelver et al. | 338/164 |
| 3,184,697 | 5/1965 | Sargent | 338/164 X |
| 3,569,894 | 3/1971 | Bolduc | 338/12 |
| 3,601,743 | 8/1971 | Mathison et al. | 338/164 |
| 3,863,194 | 1/1975 | Dorwart, Jr. et al. | 338/164 |
| 4,249,537 | 2/1981 | Lee et al. | 128/422 |

*Primary Examiner*—E. A. Goldberg
*Assistant Examiner*—M. M. Lateef
*Attorney, Agent, or Firm*—Browdy & Neimark

[57] ABSTRACT

Disclosed is a novel controller for electric devices directed to use in bath, comprising a moisture- and waterproof container that encloses the main part of an electric device; a magnet movably provided outside the container; a switch means provided inside the container, the switch means being operable by moving a movable piece; and a magnetic body equipped to the movable piece in correspondence with the moving route of the magnet.

10 Claims, 3 Drawing Sheets

CONTROLLER FOR ELECTRIC DEVICES DIRECTED TO USE IN BATH

BACKGROUND OF THE INVENTION

1. Field of the invention

The present invention relates to a controller for electric devices directed to use in a bath.

2. Description of the prior art

Electric devices such as low-frequency electrotherapeutic device must be protected from moisture and water when used while soaking in a bath tub. Although the main part of an electric device can be protected by enclosing it in an appropriate moisture- and water-proof container, the movable parts in the controller used for on/off and output controls, such as power switch and variable resistor, render perfect protection from water and moisture very difficult.

SUMMARY OF THE INVENTION

In view of the foregoing, one object of the present invention is to provide means wherein these drawbacks of conventional device are overcome, specifically, to provide a controller for electric devices directed to use in a bath wherein the movable parts of the controller are perfectly protected from moisture and water by enclosing in a container the controller together with the main part of an electric device; arranging the switch in such manner that it can be operated by moving a movable piece; and equipping a magnetic body to said movable piece so that it can be moved in association with a magnet provided outside the container.

This and other objects as may become apparent hereinafter have been attained with the controller for electric devices directed to use in bath, comprising a container that encloses the main part of an electric device; a magnet movably provided outside said container; a switch means provided inside said container, said switch means being operable by moving a movable piece; and a magnetic body equipped to said movable piece in correspondence with the moving route of said magnet.

DESCRIPTION OF THE PREFERRED EMBODIMENTS

The present invention will hereinafter be explained with reference to the accompanying drawings, in which:

FIG. 1 the side elevation view of the principal part of an embodiment according to the invention;

DETAILED DESCRIPTION OF THE PREFERRED EMBODIMENT

Figure 1:
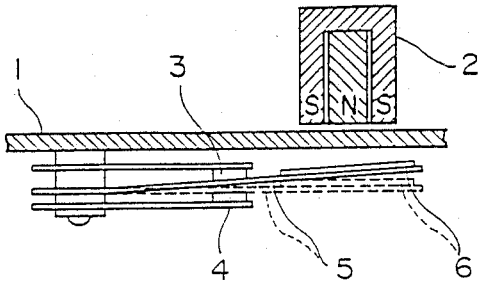

FIG. 1 is to explain the basic mechanism of the invention. Reference numeral (1) designates the container with a superiorly moisture- and water-proof structure for housing the main part of an electric device. Reference numeral (2) designates a magnet movably provided outside container (1). Magnet (2) may be of a type wherein as is the case of a bar magnet the N and S poles are located at opposite halves and are not in the same plane; or of a type wherein the N and S poles are located on the same plane by U-shaping a magnet or preparing it into a shape wherein N and S poles are placed at the center or cylindrical outer wall around the center. The latter type is preferable because it provides a stronger attraction force. Reference numerals (3) and (4) designate fixed pieces provided inside container (1) to leave an appropriate vertical spacing therebetween and also to provide a switch means. Reference numeral (5) designates a movable piece located between fixed pieces (3) and (4) so that it can contact with upper- and lower-fixed pieces (3) and (4) to switch them. Reference numeral (6) designates a magnetic body, such as iron, provided at one end of movable piece (5), and magnetic body (6) can approach magnet (2) and elevate movable piece (5) to contact movable piece (5) with fixed piece (3) when magnet (2) comes over magnetic body (6). As magnet (2) departs from magnetic body (6), the attraction force weakens and movable piece (5) descends and comes into contact with lower fixed piece (4). The on/off operation between fixed pieces (3) and (4) and movable piece (5) can be utilized to switch power source, as well as to switch resistors, capacitors and batteries to control electric resistance, capacitance and voltage.

Figure 2:
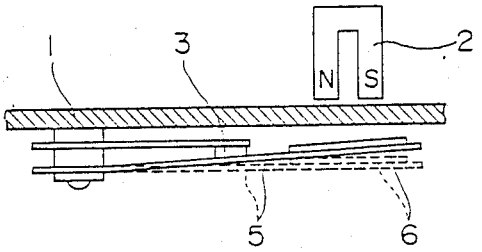
FIG. 2 is the the side elevation view of a one-way switch according to the invention.

FIG. 2 is illustrative of a one-way switch wherein lower fixed piece (4) is omitted.

Figure 3:
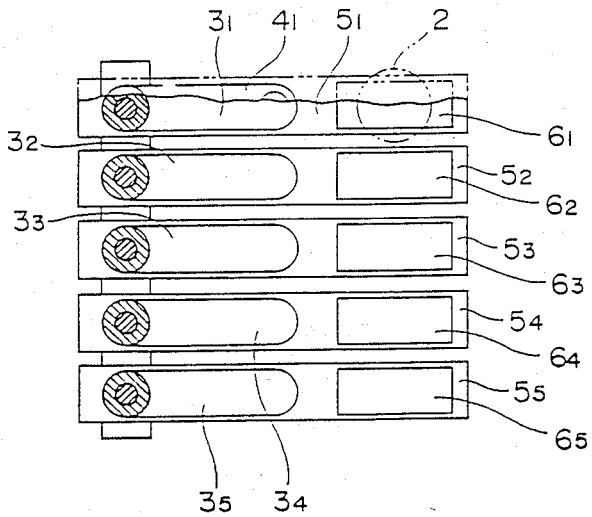
FIG. 3 is the partial cutaway plane view of an embodiment wherein a plurality of switching means is arranged.

FIG. 3 is illustrative of an application of the invention, wherein a plurality of switching means as shown in FIG. 1 is arranged in such manner that they are successively switchable by moving magnet (2). For example, when magnet (2) comes over magnetic body ($6_1$) of movable piece ($5_1$) provided in the first switching means, magnetic piece ($6_1$) approaches magnet (2) and elevates movable piece ($5_1$) to contact it with upper fixed piece ($3_1$). When this occurs, upper fixed piece ($3_1$) is turned on, while lower fixed piece (4) is turned off. As magnet (2) comes over the next switching means, the attraction force to magnetic body ($6_1$) weakens and movable piece ($5_1$) descends and contacts with lower fixed piece ($4_1$) to turn it on, as well as turning upper fixed piece ($3_1$) off. By utilizing this in a switch, power circuit can be turned on by moving magnet (2). Furthermore, by connecting resistors to second upper fixed piece ($3_2$), third upper fixed piece ($3_3$) . . . and fifth upper fixed piece ($3_5$), the resistors can be switched by moving magnet (2).

Figure 4:
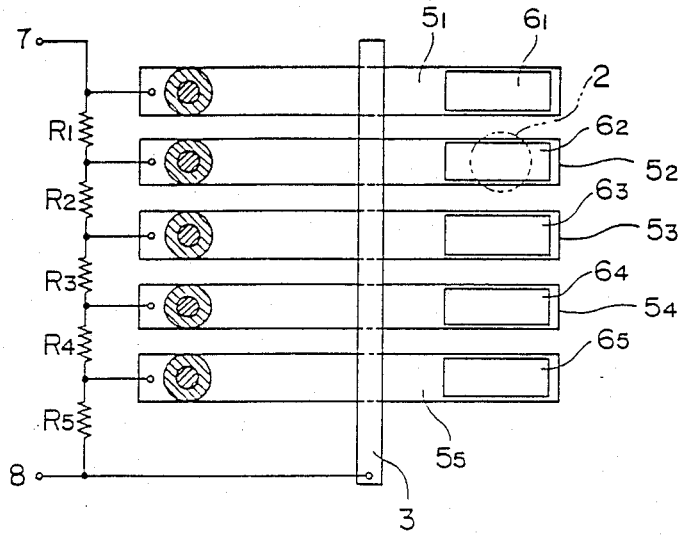
FIG. 4 is the plane view of a variable resistor according to the invention; resistor.
Figure 5:
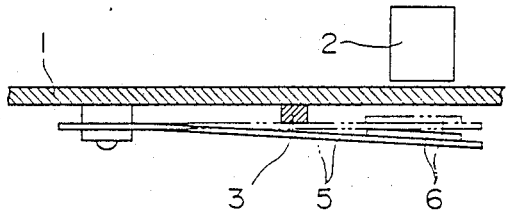
Figure 6:
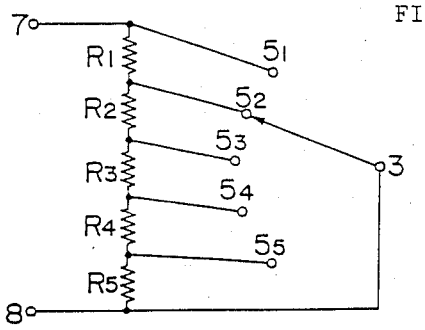
FIG. 6 is the electric circuit of the variable resistor.

FIGS. 4 and 5 are illustrative of switching resistors according to the invention, wherein a plurality of resistor $R_1$, $R_2$ . . . and $R_5$ is connected respectively with a plurality of movable piece ($5_1$), ($5_2$) . . . and ($5_5$). Only upper fixed piece (3) is provided as the common fixed piece for movable pieces ($5_1$), ($5_2$) . . . and ($5_5$) by arranging it to the direction across the movable pieces. By moving magnet (2) successively over magnetic bodies ($6_1$), ($6_2$) . . . and ($6_5$) provided at one end of respective movable pieces ($5_1$), ($5_2$) . . . and ($5_5$), magnetic bodies ($6_1$), ($6_2$) . . . and ($6_5$) successively approach magnet (2) and bring movable pieces ($5_1$), ($5_2$) . . . and ($5_5$) into contact with fixed piece (3) to turn the circuit on. As magnet (2) departs from the movable pieces, the attraction force to magnetic pieces ($6_1$), ($6_2$) . . . and ($6_5$) weakens to break the contact of the corresponding movable piece with fixed piece (3). FIG. 6 represents the electric circuit. As magnet (2) comes into contact successively with movable pieces ($5_1$), ($5_2$) . . . and ($5_5$), resistors $R_1$, $R_2$ . . . and $R_5$ are successively switched. In this way, a desired level of signal can be obtained by applying the signal between terminals (7) and (8), and controlling the electric resistance.

Figure 7:
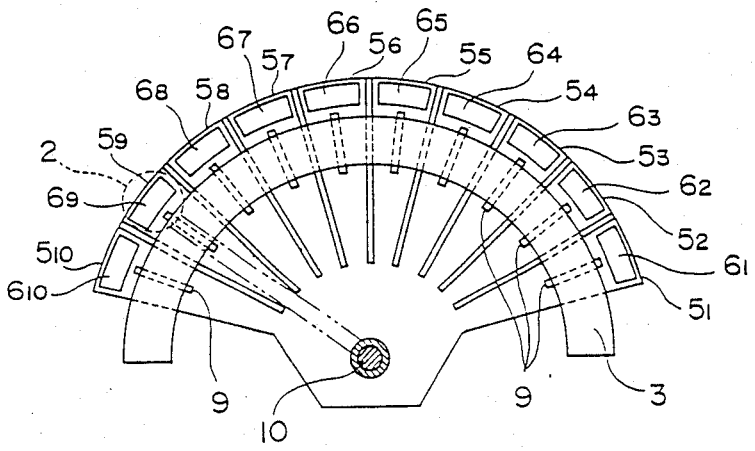
FIG. 7 is the plane view of an embodiment using sheet-type resistor.

FIG. 7 is illustrative of a variable resistor according to the invention, wherein movable pieces ($5_1$), ($5_2$) . . . and ($5_{10}$) are arranged circularly around common fixed piece (3) similarly as in the previous embodiment, while fixed piece (3) per se is made of a sheet-type resistor. Reference numeral (9) designates a contact piece provided on respective movable piece (5) in such manner that it can contact with the sheet-type resistor. Reference numeral (10) designates a rotary shaft for moving magnet (2). As magnet (2) moves, it successively attracts and elevates movable pieces ($5_1$), ($5_2$) . . . and ($5_{10}$) to bring them into contact with fixed piece (3). In this way, a controlled electric resistance can be obtained.

Figure 8:
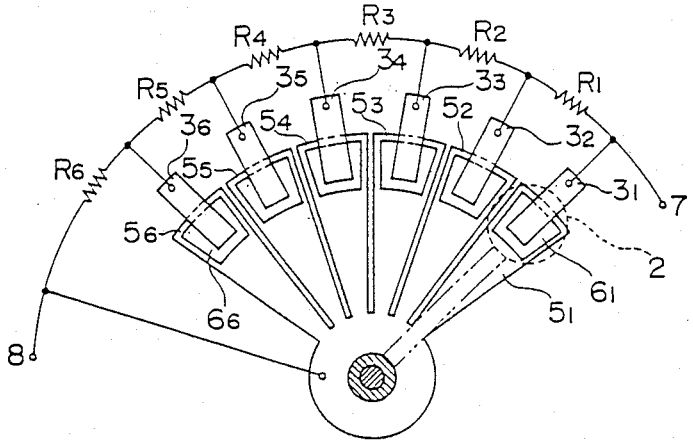
FIG. 8 is the plane view of a radial resistor switch.

In the embodiment as shown in FIG. 8, fixed pieces ($3_1$), ($3_2$) . . . and ($3_6$) are attached to the ends of radially-arranged movable piece ($5_1$), ($5_2$) . . . and ($5_6$), while resistors $R_1$, $R_2$ . . . and $R_6$ are connected between adjacent two fixed pieces. Thus, the electric resistance can be controlled by moving magnet (2) to successively contact movable pieces ($5_1$), ($5_2$) . . . and ($5_6$) with fixed pieces ($3_1$), ($3_2$) . . . and ($3_6$).

As described above, in the present invention the movable parts in the controller can be perfectly protected from moisture and water because the controller is enclosed in the container together with the main part of an electric device, and because the control switch is operable by moving a movable piece including a magnetic body which moves in association with a magnet provided outside the container. Thus, the controller can be advantageously used in electric devices directed to the use while soaking in a bath tub such as low-frequency electrotherapeutic device.

Such low-frequency electrotherapeutic device is very effective in improving and treating blood circulation, muscular strength and haemorrhoids, as well as in relieving fatigue.

Having described specific embodiments of my bearing, it is believed obvious that modifications and variations of my invention are possible in light of the above teachings.

I claim:

1. A controller for electric devices directed to use in bath, comprising:

a plurality of switching means provided in parallel to leave appropriate spacings between adjoining switching means, each switching means comprising at least one fixed piece, and a movable piece having a magnetic body faced with said fixed piece to leave an appropriate spacing;

a container hermetically enclosing said plurality of switching means; and a magnet movably provided outside said container in such manner that, when said magnet moves along said plurality of switching means, the attractive or repulsive force successively brings the movable pieces into contact with their corresponding fixed piece.

2. The controller of claim 1, wherein each switching means comprises two fixed pieces, and a movable piece having a magnetic body provided between the fixed pieces such manner that the movable piece is in contact with one fixed piece but not with the other fixed piece.

3. The controller of claim 1, wherein a rotary shaft having an arm attached with said magnet is hermetically provided through said container, and wherein said plurality of switching means are radially provided around said rotary shaft.

4. The controller of claim 1, wherein said magnetic body is made of iron.

5. The controller of claim 1, wherein said magnet is of a type wherein the N and S poles are located on the same plane.

6. The controller of claim 1, wherein a sheet member is fixed over the movable pieces to provide a common fixed piece.

7. The controller of claim 6, wherein said sheet member is a sheet-type resistor.

8. The controller of claim 1, wherein a member, selected from the group consisting of resistor, capacitor, and battery is connected between adjoining switching means.

9. The controller of claim 1, which is directed to use in a low-frequency electrotherapeutic device.

10. The controller of claim 1, wherein said container is of a moisture and water-proof structure.

* * * * *